US005306190A

United States Patent [19]

Spina et al.

[11] Patent Number: 5,306,190

[45] Date of Patent: Apr. 26, 1994

[54] FORMING PROCESS FOR A SHEET OF PERFORATED METAL AND PROCESS IMPLEMENTATION DEVICE

[75] Inventors: Paolo Spina, Ferentino; Carlo L. Fonda, Anagni; Marco Visconti, Rome, all of Italy; Eric M. Jego, Gouvernes, France

[73] Assignee: Videocolor SpA, Anagni, Italy

[21] Appl. No.: 910,796

[22] Filed: Jul. 9, 1992

[30] Foreign Application Priority Data

Oct. 23, 1991 [IT] Italy ..... M191A002807

[51] Int. Cl.[5] ..... H01J 9/14

[52] U.S. Cl. ..... 445/68; 445/47; 72/38; 72/364; 100/938

[58] Field of Search ..... 445/37, 47, 68; 100/93 P; 72/364, 38

[56] References Cited

U.S. PATENT DOCUMENTS

| | | | |
|---|---|---|---|
| 3,152,384 | 10/1964 | Toohig et al. | 445/37 |
| 3,234,055 | 2/1966 | Feng | 72/38 |
| 3,345,846 | 10/1967 | Hess | 72/38 |
| 3,434,910 | 3/1969 | Kannegiesser et al. | 100/93 P |
| 3,440,858 | 4/1969 | Motley et al. | 72/364 |
| 4,536,226 | 8/1985 | Ohtake et al. | 148/12 |
| 4,792,318 | 12/1988 | Igaki et al. | 445/66 |
| 5,026,312 | 6/1991 | Van Den Berg | 445/47 |

FOREIGN PATENT DOCUMENTS

| | | | |
|---|---|---|---|
| 179506 | 9/1984 | European Pat. Off. . | |
| 124354 | 11/1984 | European Pat. Off. . | |
| 246838 | 11/1987 | European Pat. Off. . | |
| 2306724 | 8/1973 | Fed. Rep. of Germany | 72/38 |

*Primary Examiner*—Kurt C. Rowan
*Assistant Examiner*—Jeffrey T. Knapp
*Attorney, Agent, or Firm*—Joseph S. Tripoli; Dennis H. Irlbeck; Vincent J. Coughlin, Jr.

[57] ABSTRACT

A process for forming a color selection mask for a CRT, in a press containing a punch and a counter-punch, after a temperature build-up stage in a shaping chamber, through the circulation of pressurized hot gas injected by inlets placed on the walls of the counter-punch, includes the step of distributing the hot gas through a distribution device to uniformly heat the mask's surface.

7 Claims, 4 Drawing Sheets

Fig. 1
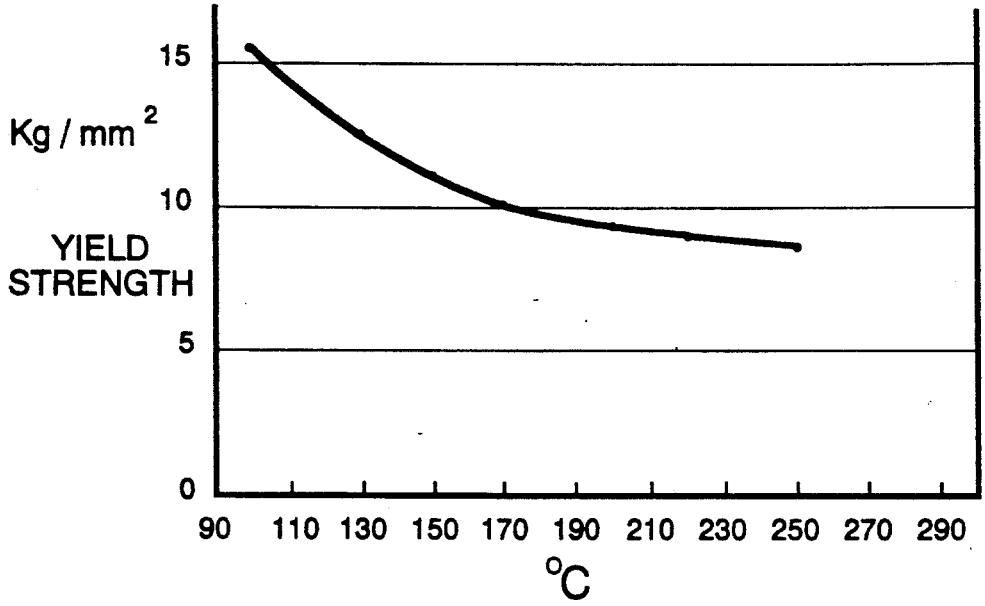
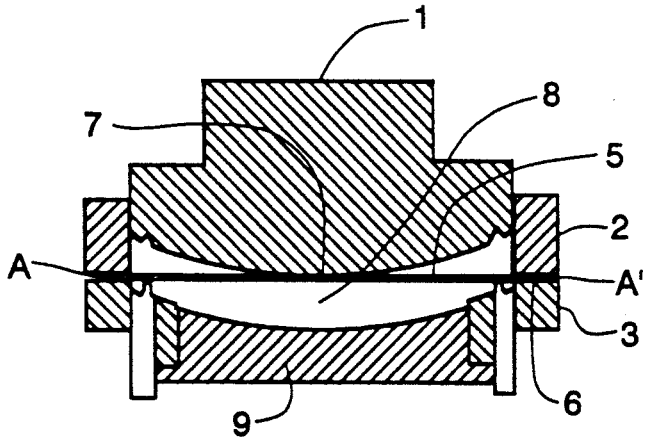
Fig. 2
Prior Art
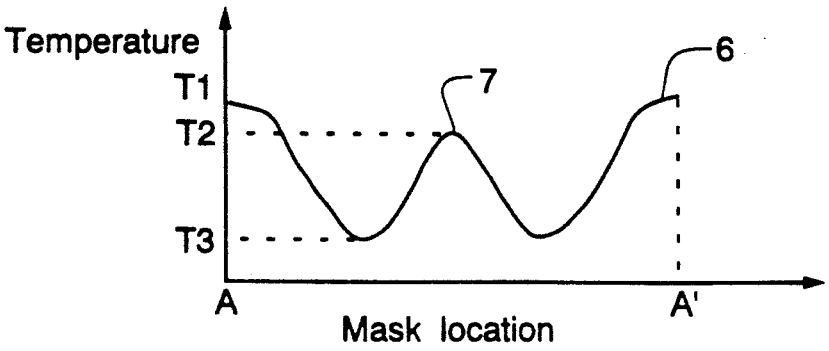
Fig. 3
Prior Art

Fig. 5a
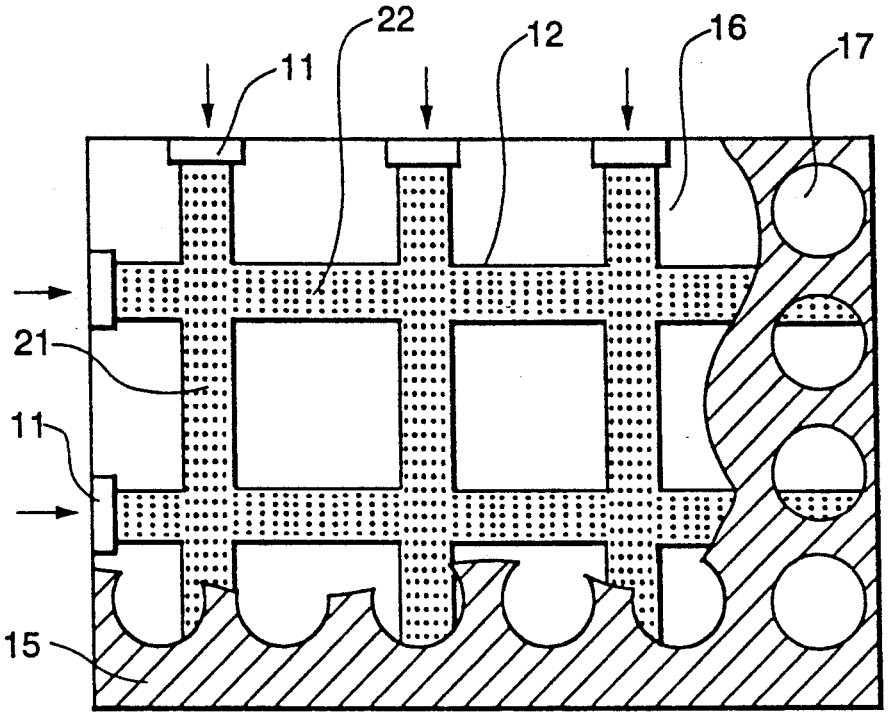
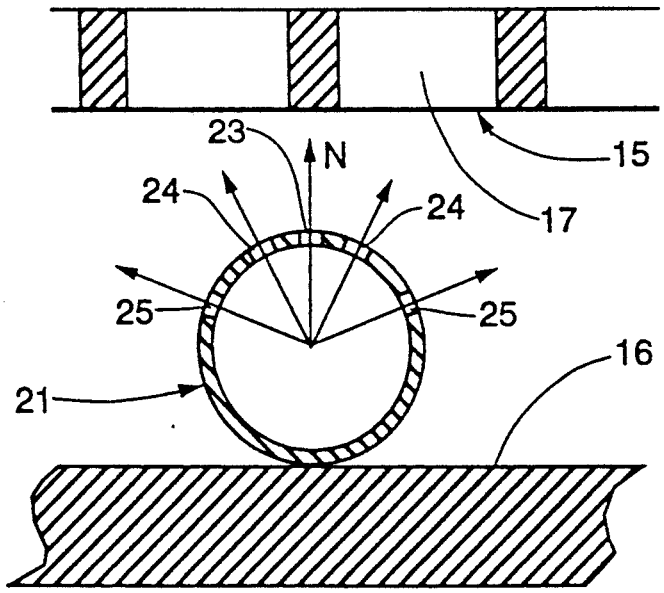
Fig. 5b

FORMING PROCESS FOR A SHEET OF PERFORATED METAL AND PROCESS IMPLEMENTATION DEVICE

This invention relates to a process for forming a sheet of perforated metal, whereby a color selection mask can be manufactured for a cathode ray tube (CRT). The device for forming the metal sheet also is described.

BACKGROUND OF THE INVENTION

A CRT designed to reproduce color images generally includes a gun for generating three separate electron beams which converge towards the internal surface of the screen. Cathodoluminescent materials are deposited as phosphor stripes or dots on this surface and emit red, green or blue light when the respective electron beams impinge thereon. A perforated metal mask, spaced a very short distance from the internal surface of the screen, facilitates the selection of the colors so that the electron beams emitted by the gun only reach the corresponding phosphor elements, excluding all the others. The color selection mask requires a very precise shape and its distance from the internal surface of the screen guarantees the purity of the colors of the image formed on the screen. Only a small fraction of the electrons emitted by the gun (between 20 and 30%) are transmitted through the mask to reach the screen. The remainder impinge upon the imperforate portion of the mask and impart their energy to the mask, which heats up to a temperature of around 70°–80° C. This heating causes expansion of the mask material and modifies the position of the impact points of the electron beams on the phosphor screen elements, resulting in a loss of color purity as electron beams excite several phosphor elements of different emissive colors. Masks produced from sheets of low carbon steel are highly sensitive to this thermal expansion phenomenon. It is difficult with such masks to produce images of high luminosity or brightness without any loss of color purity.

European patent number 124354 proposes the use of an alloy with a low thermal expansion coefficient (e.g. iron/nickel), as material for the production of perforated masks. Nevertheless, this type of alloy possesses a strong tension or stiffness and the yield strength, at ambient temperature, makes it difficult to press-form the mask as the metal sheet (approximately 200 μm thick) tends to return to its original shape if the yield limit is not exceeded. The solution envisaged by patent EP 124354 consists in pressing the mask from an iron/-nickel alloy sheet at a temperature at which the value of the elasticity coefficient is lowest and, for example, close to that of mild steel, this temperature being about 150°–200° C. for a 35 wt % nickel 65 wt % iron alloy.

The mask forming temperature is generally obtained via a press whose punch and counter-punch, designed to give final shape to the mask, are heated to a temperature higher than that of the mask. The mask is then heated by convection, conduction and radiation in the chamber containing the punch and counter-punch. When the mask has reached the required temperature, it is then pressed by the punch. This prior shaping process has a number of drawbacks:

before being shaped, the mask material has its periphery in contact between the punch and counter-punch, and its center with the punch: in this configuration the transmission of heat is non-uniform.

heating by conduction and radiation requires bringing the press parts, which are to provide this heating, up to a temperature greater than the required temperature of the mask material, which entails a high consumption of energy and mechanical problems because it is difficult to maintain the moving parts of a press at high temperature.

the time required to bring the mask material up to the pressing temperature greatly increases the length of the shaping stage of the operation as compared to that of a mask made of mild steel and requires more mask-shaping, or pressing stations, to obtain a correct rate of production.

Alternatively, the temperature of the mask can be built up in a furnace outside the press; however, this involves problems of handling and loss of energy due to the low thermal capacity of the thin perforated sheet used for the mask. As described in EP 124354, the mask material can also be heated by immersion in an oil bath which involves problems both of handling and maintenance of the press's environment.

SUMMARY OF THE INVENTION

The novel process for forming a sheet of perforated metal is both simple and requires little energy, while providing uniform and rapid heating of the metal prior to pressing. This process can utilize a conventional press through the addition of a heating device which also is the subject of this invention. The process for forming the metal requires that the heat necessary to raise the temperature of the metal, prior to pressing, be supplied by a pressurized hot gas which is circulated through the perforations in the metal.

BRIEF DESCRIPTION OF THE DRAWINGS

FIG. 1 shows the variation in the yield strength as a function of temperature of an iron/nickel alloy containing approximately 35 wt % nickel, which has been annealed at 950° C.

FIG. 2 is a cross-sectional view of an example of a prior art color selection mask shaping device.

FIG. 3 shows the distribution of the temperature along a line joining the center and the two opposite sides of the mask, during its shaping by the device in FIG. 2.

FIG. 5*a* is a top view of the device for distributing the gas inside the heating chamber, and FIG. 5*b* shows a cross-section of a component of the gas distribution system as embodied by this invention.

DETAILED DESCRIPTION OF THE PREFERRED EMBODIMENTS

Figure 4:
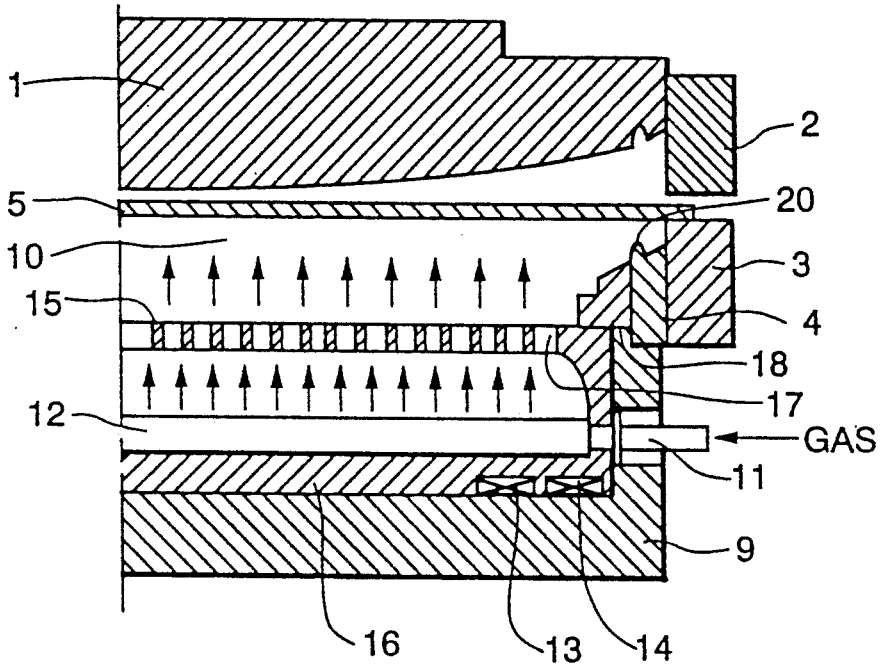
FIG. 4 is a cross-sectional view of the device of the present invention, schematically showing a heating chamber placed inside the counter-punch of the press and supplied with pressurized hot gas.

The new generations of CRT's, designed to provide images of improved quality, employ color selection masks made of an iron/nickel alloy, also known as INVAR. This material has a nickel composition of between 32 and 42 wt. % and a lower thermal expansion coefficient than steel, so that the masks are less susceptible to expansion caused by the electron bombardment of the beams from the guns. Nevertheless, INVAR has a far higher tension and yield strength than steel, at room temperature, so it is necessary to shape the mask at a high temperature. As shown in FIG. 1, the yield strength of the INVAR decreases with increasing temperature and tends towards a value at around 200° C. that is comparable to that of mild steel. The curve in FIG. 1 shows the variation in yield strength of the INVAR manufactured by the firm NYK after annealing at 950° C.

As shown in FIGS. 2 and 3, a mask 5, heated by the exchange of heat with the parts of the press performing the forming operation, does not have a uniform temperature on its surface. The flat perforated mask sheet used to form mask 5 is locked in position by parts 2 and 3 and is heated by conduction, by a peripheral contact 6 with these parts and, in the volume 8 defined by the punch 1 and the counter-punch 9, by convection; and by radiation, because parts 1 and 9 are brought up to high temperature. When the punch 1 is lowered to shape the mask, by coming into contact with it (at point 7 in FIGS. 2 and 3) the temperature distribution on the mask surface is altered; thus, there may be differences in temperature of more than 20% from one point to another on the mask. Now, if certain parts of the mask have not achieved the desired temperature at which the elasticity coefficient is more or less constant, from the mechanical point of view, these certain parts will behave differently from the other parts which have reached the desired temperature. As a result, the holes in the mask may be subject to more or less complete permanent deformation during the shaping operation, depending upon whether the surface on which the holes are located has or has not achieved the desired temperature for which the value of the material's yield strength is sufficiently low. To obtain predictable and uniform deformation of the holes in the mask, it is therefore necessary to wait until the entire surface reaches a minimum temperature of about 200° C., which means that in a shaping device, such as those known in the art, the parts such as the punch and counter-punch should be brought up to temperatures of at least 240°-250° C. To obtain these conditions, the heating time of a mask with a surface area of about 0.41 $m^2$ and a thickness of 0.215 mm, is about 30 seconds. This heating time considerably prolongs the shaping time, which adds to the manufacturing cost of the CRT.

The device in FIG. 4, which embodies the invention, provides for the forming of the mask in a far shorter time while providing uniform build-up of temperature on the surface of the mask. The counter-punch 9 has been hollowed out to form, with the sheet of perforated metal 5, a shaping chamger 10 which contains a hot gas of high density, in this case air at approximately 240°-250° C. The gas enters the shaping chamber under pressure from a multiplicity of gas ports 11 (only one of which is shown) located on the side walls of the counter-punch. An exchange of heat will then occur between the gas and the mask, due to the forced convection through the perforations in the mask. The gas will also heat the punch 1 before being discharged through the side of the press. When the flat mask sheet has reached its pressing temperature, of around 200° C. over the entire surface, jaws 2 and 3 then pinch or clamp the mask sheet at its periphery. Punch 1 is lowered into chamber 10 providing the final curved shape to the perforated part of the mask 5. It may be advantageous to provide a stiffening rib on the circumference of the mask, as is known in the art, so as to increase its mechanical rigidity. This rib is formed by the rounded protuberance 20 of the part 4 secured to the counter-punch cooperating with the complementary hollow formed in the punch 1. The withdrawal of punch 1 and the opening of jaws 2 and 3, release the mask.

To increase the mechanical rigidity of the side walls of the counter-punch 9 and prevent their collapsing under the action of the punch 1, a rigidity plate 15 is placed inside the shaping chamber 10 and secured to the side walls of the counter-punch. The metal plate 15 has a multitude of holes 17 provided therethrough which extend over the entire surface to enable the gas to flow through it and, owing to the speed of flow, to heat the mask quickly, efficiently, and uniformly. In one embodiment of this invention, plate 15 has been produced in a sheet of steel 18 mm thick and provided with 20 mm diameter holes distributed uniformly over its surface and spaced about 25 mm from each other.

The skirt (not shown) of the mask 5 is shaped by the action of the punch 1 and by contact with parts 3, 4, and 18 of the counter-punch 9. These parts are also heated to a temperature of at least 200° C. in order to shape the skirt of the mask at a low value of the component material's yield strength. These voluminous steel parts of the counter-punch 9, owing to their high thermal capacity, cannot be kept continuously at a constant temperature simply by the hot circulating air. Electrical resistors 13 and 14, through which a heating current flows, are therefore advantageously placed along the periphery of the counter-punch 9, either on the horizontal part 16 forming the bottom of the shaping chamber 10, as indicated in FIG. 4, or inserted into one of the parts 3, 4, or 18 forming the side walls of the counter-punch. These resistors monitor and maintain the temperature of the aforementioned parts of the counter-punch which shape the skirt of the mask 5.

It has been determined that the gas, conveyed under pressure via ports 11 placed on the circumference of the counter-punch, when expanding in chamber 10 undergoes a pressure drop so that the flow of gas through the mask 5 is higher at its center than at its periphery. The lack of uniformity of the air stream causes more efficient heating of the central part of the mask than its periphery. To avoid this problem and thus reduce the overall heating time of the mask, according to a preferential embodiment of this invention, a hot gas distribution device 12 has been placed inside chamber 10, in the space between the horizontal bottom 16 of the counter-punch and rigidity plate 15, so that the stream of air injected into the chamber is distributed uniformly over the entire surface of the mask.

As shown in FIG. 5*a*, the distribution system 12 consists of first parallel tubular elements 21 connected to the pressurized gas inlets 11 place on the longest sides of the counter-punch 9 and second parallel tubular elements 22 connected to the gas inlets 11 placed on the shortest sides of the counter-punch. These tubular elements 21 and 22 are provided with openings to let the gas escape and heat the mask. Because the pressure drop is negligible inside each of the tubular elements, the distribution of the gas over the surface of the mask is more uniform. As indicated in FIG. 5*b*, the openings 23 are arranged on the part of elements 21 and 22 opposite plate 15 and the mask, and on the radial axes perpendicular to the mask. To improve the distribution of the hot gas, the tubular elements 21 and 22 may each be provided with additional openings 24 and 25 located on the radial axes of the elements, at angles oblique to the normal, N. Preferably, the openings 24 are located on the radial axes forming an angle of 25° with the normal, N, and the openings 25 are located on the radial axes forming an angle of 60° with the normal, N.

Figure 6A:
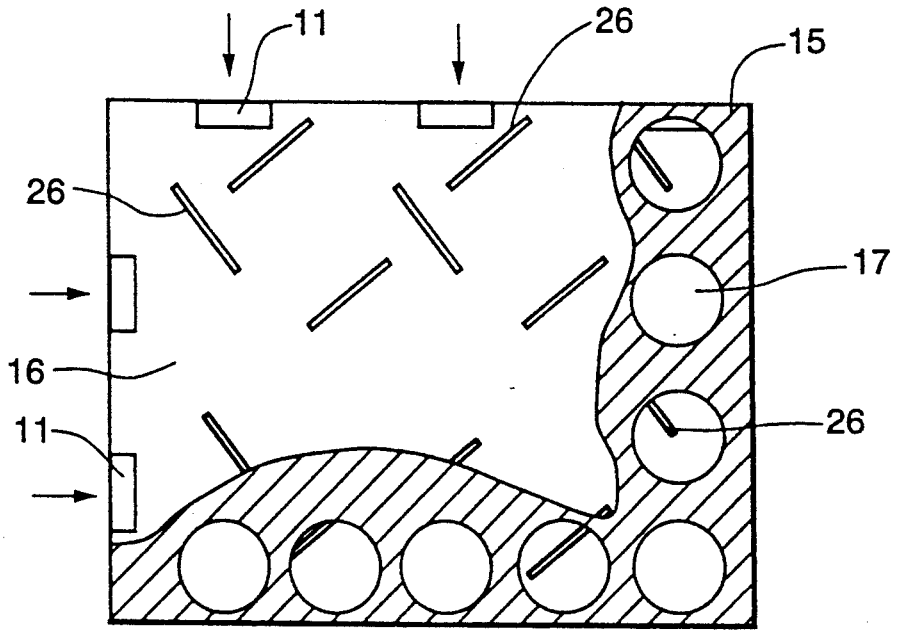
FIGS. 6*a* and 6*b* show alternative versions of the gas distribution device in the heating chamber.

In a second embodiment, the system for distributing the hot gas onto the surface of the mask, is illustrated by FIG. 6*a*. A multiplicity of flat deflectors 26 are placed in the space between the horizontal bottom 16 of the counter-punch and the rigidity plate 15. These deflectors 26 are disposed in planes perpendicular to the plane of the mask (not shown), so as to direct the stream of gas, injected in inlets 11, perpendicular to the surface of the mask to be heated. It has been observed that the distribution of the gas on the surface of the mask was made more homogeneous if the planes of the deflectors were placed oblique in relation to the direction of the gas streams injected in inlets 11.

Figure 6B:
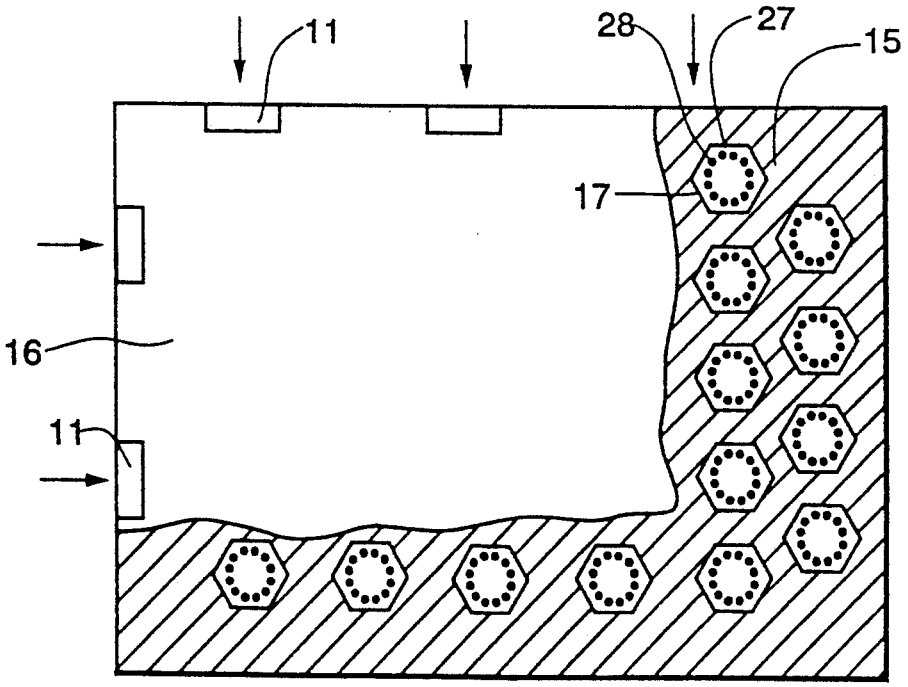

According to a third embodiment of the system for distributing hot gas onto the surface of the mask, illustrated in FIG. 6*b*, jets 27 are placed in the holes 17 of the plate 15. Each of the jets 27 has a spherical shaped head, located on the mask side, through which a plurality of apertures 28 are provided, thus enabling the gas, pressurized in the space between the plate 15 and the horizontal bottom 16 of the counter-punch 9, to escape in all directions toward the surface of the mask.

In all the embodiments described herein, the distribution systems provide a sufficient flow of gas so that the gas in contact with the mask is at a constant and uniform temperature. It has been determined that these conditions require that the velocity of gas towards the mask be at least 0.1 m/s, or greater.

Whereas, through the prior art device, more than 30 seconds were required to bring the mask with a surface area of 0.41 $m^2$ and a thickness of 0.215 mm from a temperature of 20° C. up to 200° C., the heating time for an identical mask according to the process of the first embodiment of the invention (speed of gas towards the surface of the mask greater than 0.1 m/s, supplied by a tubular-type distribution system described in FIGS. 5*a* and 5*b*) and using air as the heating gas, are the following:

| Temperature of heating gas | 220° | 250° | 300° |
|---|---|---|---|
| Heating time | 18 sec. | 12 sec. | 8 sec. |

What is claimed is:

1. A device for forming a sheet of perforated metal comprising clamping means, a punch and a counter punch, said counter punch being within a shaping chamber having a horizontal bottom part, said shaping chamber being supplied with pressurized hot air to heat said sheet of perforated metal and said device to a forming temperature of said sheet of perforated metal, wherein said shaping chamber includes a hot air distribution system between said horizontal bottom part of said shaping chamber and a rigidity plate which divides said shaping chamber into two volumes.

2. The device as claimed in claim 1 wherein the hot air distribution system consists of jets inserted in openings of said rigidity plate separating the chamber into two volumes.

3. The device as claimed in claim 1 wherein the air distribution system comprises tubular elements provided with openings.

4. The device as claimed in claim 3 wherein the openings in said air distribution system tubular elements are placed on the radial axes normal to the plane formed by said horizontal bottom part.

5. The device as claimed in claim 4 wherein the openings in said air distribution system tubular elements also are placed on the radial axes oblique to the plane formed by said horizontal bottom part.

6. The device as claimed in claim 1 wherein the hot air distribution system consists of a multiplicity of deflectors placed in planes substantially perpendicular to the surface of said horizontal bottom part.

7. The device as claimed in claim 6 wherein said deflectors are placed obliquely in relation to the directions of the streams of air entering into the chamber.

* * * * *